United States Patent [19]

Wangard et al.

[11] 4,322,996

[45] Apr. 6, 1982

[54] ALTERNATING REPEAT KEYING SIGNAL GENERATOR

[75] Inventors: William Wangard, Melrose Park; David Starkey, Oak Park, both of Ill.

[73] Assignee: Norlin Industries, Inc., White Plains, N.Y.

[21] Appl. No.: 140,802

[22] Filed: Apr. 16, 1980

[51] Int. Cl.[3] ..... G10H 1/30

[52] U.S. Cl. ..... 84/1.24; 84/1.26; 84/DIG. 12; 340/365 S

[58] Field of Search ..... 84/1.01, 1.03, 1.13, 84/1.24, 1.26, DIG. 7, DIG. 12, DIG. 23; 340/365 R, 365 S

[56] References Cited

U.S. PATENT DOCUMENTS

| | | | |
|---|---|---|---|
| 3,821,458 | 6/1974 | Schreier | 84/1.13 |
| 3,910,150 | 10/1975 | Deutsch et al. | 84/1.03 |
| 4,012,982 | 3/1977 | Southard | 84/1.01 |
| 4,052,924 | 10/1977 | Deutsch et al. | 84/1.24 |
| 4,085,643 | 4/1978 | Griffith | 84/1.01 |
| 4,133,244 | 1/1979 | Hiyoshi et al. | 84/1.26 |
| 4,145,946 | 3/1979 | Deutsch | 84/1.26 |
| 4,163,222 | 7/1979 | Gove | 340/365 S |
| 4,178,825 | 12/1979 | Deutsch | 84/1.24 |
| 4,207,792 | 6/1980 | Hoskinson | 84/1.01 |

*Primary Examiner*—S. J. Witkowski

*Attorney, Agent, or Firm*—Ronald J. Kransdorf; Jack Kail

[57] ABSTRACT

A circuit for generating alternating repeat keying signals in an electronic keyboard musical instrument includes a clock, a logic circuit responsive to the keys of the instrument and to the clock for producing an alternating sequence of logic signals corresponding to each of the keys, the phase of the sequence corresponding to each undepressed key being the same as the phase of the sequence corresponding to the previous key and the phase of the sequence corresponding to each depressed key being opposite that of the phase of the sequence corresponding to the previous key and a plurality of output gates each developing a keying signal in response to the depression of a respective one of the keys and the logic signals of the corresponding sequence assuming a predetermined state.

12 Claims, 7 Drawing Figures

ALTERNATING REPEAT KEYING SIGNAL GENERATOR

BACKGROUND OF THE INVENTION

The present invention relates generally to electronic keyboard musical instruments and, more particularly, to a circuit for developing alternately repeating keying signals of the type typifying the playing of, for example, a marimba.

A marimba is a percussive musical instrument normally played by alternately striking two groups of one or more bars of the instrument to produce a repetitive musical pattern. Attempts have heretofore been made to simulate this effect in an electronic keyboard musical instrument, e.g. an electronic organ, wherein a pair of notes are repetitively caused to sound in an alternating manner by depressing or holding down the keys corresponding to the two notes. The effect may also be simulated when more than two keys are depressed by grouping the depressed keys into two groups, all of the notes within each group being sounded simultaneously.

Prior art circuits adapted for simulating the foregoing alternating repeat effect typically incorporate an alternating bus scheme wherein each key of the keyboard is coupled to one of a pair of buses, the two buses being alternately energized by a suitable oscillator. As a result, depressing at least one key coupled to each of the buses causes the corresponding notes to alternately sound on a repetitive basis. A major problem with this type of circuit is that there are certain combinations of notes which do not alternate when the corresponding keys are depressed or that alternate in a very undesirable manner. For example, if two keys are depressed both of which are coupled to the same bus, the corresponding notes will not be alternately sounded but, rather, will be simultaneously sounded in a repetitive manner. Also, if a plurality of keys are depressed, a large number of which are coupled to one bus while a smaller number are coupled to the second bus, the alternately sounding signals will be composed of correspondingly different numbers of notes creating an undesirable musical effect.

While the foregoing problems are relatively serious in a conventional electronic organ where each key is associated with its own individual keyer, the problems are further compounded in a computer or microprocessor based organ. In organs of the latter type only a limited number of tone generator sources are normally provided, each of the tone generator sources being programmable and assignable together with one of a limited number of keyers for producing the tone signal corresponding to any key of the organ. Since it is therefore not known beforehand which of the tone generators and keyers will be assigned to any particular key, the prior art alternating bus scheme is particularly unsuited for use in this type of an organ.

SUMMARY OF THE INVENTION

It is, therefore, an object of the present invention to provide an electronic keyboard musical instrument having an alternating repeat feature not limited by the foregoing problems and which may be easily implemented in either a conventional or a microprocessor based electronic organ.

According to the invention, a succession of exclusive OR gates are provided each having a first input coupled to a respective one of the keys of the keyboard of an electronic musical instrument. The second input of the first of the succession of exclusive OR gates is connected for receiving a clock signal, preferably having a 50% duty cycle, while the second input of each of the remaining exclusive OR gates is coupled to the output of the immediately preceding gate. As a result, the output of each of the exclusive OR gates consists of a sequence of alternating logic signals, the phase of each sequence associated with an exclusive OR gate connected to an undepressed key being the same as the phase of the sequence associated with the exclusive OR gate connected to the previous key and the phase of each sequence associated with an exclusive OR gate connected to a depressed key being opposite that of the phase of the sequence associated with the exclusive OR gate connected to the previous key. Each of the sequences of logic signals is then coupled to a gate which repetitively develops a keying signal in response to the depression of the associated key. As a consequence of the phase characteristics of the sequences of logic signals, depression of two keys results in the repetitive keying signals alternately sounding the two corresponding notes. When more than two keys are depressed, the corresponding notes are sounded alternately in two groups, each group containing an equal number of notes or one group containing one note more than the other.

DESCRIPTION OF THE PREFERRED EMBODIMENT

Figure 1:
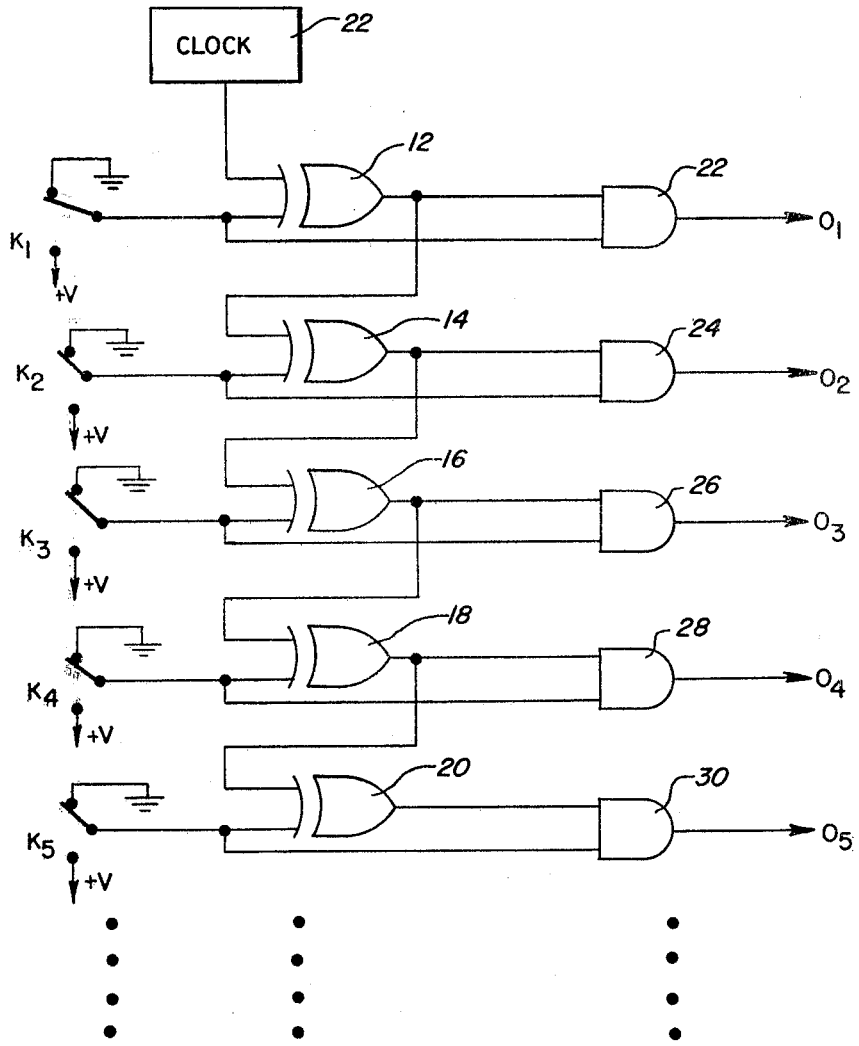
FIG. 1 is a logic diagram showing a basic form of the alternating repeat circuit of the present invention.

Referring to FIG. 1, a basic embodiment of the alternating repeat circuit of the invention comprises a succession of exclusive OR gates each having one input connected to the output of a respective key switch of an electronic keyboard musical instrument. For purposes of simplicity and clarity only five of the key switches $K_1$–$K_5$ together with the five associated exclusive OR gates 12, 14, 16, 18 and 20 have been shown, it being understood that, in general, a similarly connected exclusive OR gate could be provided for each of the remainder of the keys of the keyboard. The order of connection of the key switches to the exclusive OR gates is not critical so that, for example, the key switches $K_1$–$K_5$ could represent notes consecutively increasing in pitch or consecutively decreasing in pitch or some other selected arrangement.

The second input of the initial exclusive OR gate 12 is derived from the output of an alternating repeat oscillator or clock 22 which produces a substantially 50% duty cycle square wave clock signal having a repetition rate between about 2–15 Hz. The output of each of the exclusive OR gates 12–20 is coupled to one input of a respective one of a series of AND gates 22, 24, 26, 28 and 30 and also to the second input of the succeeding exclusive OR gate 14–20. Thus, for example, the output of exclusive OR gate 12 is connected to a first input of AND gate 22 and also to the second input of exclusive OR gate 14. The second input of each of the AND gates 22, 24, 26, 28 and 30 is derived from the key switch $K_1$–$K_5$ associated with the exclusive OR gate whose output is coupled to the first input of the respective AND gate. By way of example, the second input of AND gate 22 is derived from key switch $K_1$ which also supplies one input of exclusive OR gate 12. As will be explained in further detail hereinafter, the outputs $O_1$–$O_5$ of the AND gates 22–30 develop keying signals which are coupled to the keyers of the instrument for achieving an alternating repeat effect. In this regard, the instrument may be of conventional design wherein an individual keyer would be provided for receiving the keying signals developed at the output of each of the AND gates 22–30 or, alternatively, the instrument may incorporate a microprocessor based time-shared design in which case a limited number of keyers would be provided each assignable together with a tone generator source for receiving the keying signals developed at the output of each of the AND gates 22–30.

While the circuit of FIG. 1 has been described and illustrated as comprising a succession or series of exclusive OR gates, it is to be understood that, as used herein, the term "exclusive OR gate" is intended to encompass any logic element or combination of logic elements which performs the logical operation attributable to an exclusive OR gate. In particular, an exclusive OR gate performs the logical operation illustrated in Table I below:

TABLE I

| | | | | |
|---|---|---|---|---|
| Input 1 | 0 | 0 | 1 | 1 |
| Input 2 | 0 | 1 | 0 | 1 |
| output | 0 | 1 | 1 | 0 |

Therefore, an exclusive OR gate provides a logical 1 output signal only if one or the other, but not both of its inputs are logical 1. Another way of looking at this logical operation is by considering the exclusive OR gate as a programmable inverter. That is, designating one of the inputs as a control port, the exclusive OR gate will invert the other input when the control port is logical 1 and will act as a non-inverting buffer when the control port is logical 0.

In operation, a square wave signal forming a sequence of alternating logical 1 and logical 0 signals will be developed at the output of each of the exclusive OR gates 12–20 in response to the clock 22 and the key switches $K_1$–$K_5$. For instance, assuming that key switch $K_1$ is not depressed whereby a logical 0 signal is coupled therefrom to the first input of exclusive OR gate 12, a logical 1 signal is developed at the output of the exclusive OR gate in response to the output of clock 22 assuming a logical 1 state. The output of exclusive OR gate 12 will next assume a logical 0 state in response to the output of clock 22 transitioning to a logical 0 state. The foregoing operation is continuously repeated whereby a square wave signal comprising an alternating sequence of logical signals of the form 1-0-1-0 . . . is produced at the output of exclusive OR gate 12 in response to a square wave clock signal representing a sequence of logic signals of the form 1-0-1-0 . . .

Next, assume that the second key-switch $K_2$ is also not depressed whereby a logical 0 signal is coupled therefrom to the second input of exclusive OR gate 14. As a result, exclusive OR gate 14 will act as a non-inverting buffer coupling the logic signals presented to its first input from the output of exclusive OR gate 12 to its output. A square wave signal is therefore produced at the output of exclusive OR gate 14 comprising an alternating sequence of logic signals of the form 1-0-1-0 . . . Now, assume that the second key switch $K_2$ is depressed so that a logical 1 signal is coupled to its second input. In this case, the exclusive OR gate 14 is operated for inverting the logic signals presented to its first input from the output of exclusive OR gate 12. As a consequence, a square wave signal is developed at the output of exclusive OR gate 14 comprising an alternating sequence of logic signals of the form 0-1-0-1 . . . With regard to the output of exclusive OR gate 14, it will be observed that a sequence of alternating logic signals is produced whose phase is the same as that of the output of the preceding gate, i.e. exclusive OR gate 12, when its associated key switch $K_2$ is unoperated and of opposite phase when the key switch $K_2$ is depressed. It will further be appreciated that each of the remaining exclusive OR gates of the circuit operates in a similar manner. Therefore, in general, it is a feature of the circuit of FIG. 1 that the output of each of the exclusive OR gates comprises a square wave signal representing an alternating sequence of logic signals whose phase is the same as that of the sequence produced at the output of the immediately preceding gate when its associated key switch is unoperated and opposite that of the sequence produced at the output of the immediately preceding gate when its associated key switch is depressed. As will be explained in further detail hereinafter, this feature insures that when any two or more key switches are depressed, the corresponding notes will be alternately sounded in two groups, the two groups containing the most nearly equal division of notes possible.

Figure 2A:
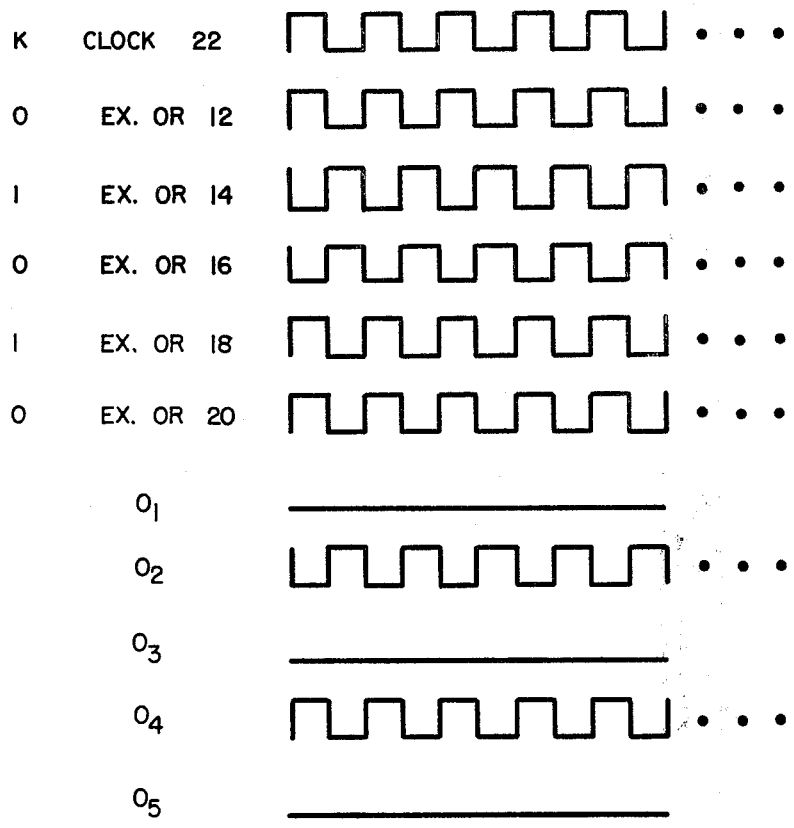
FIGS. 2A–2C are a series of waveform diagrams illustrating the operation of the alternating repeat circuit of FIG. 1.
Figure 2B:
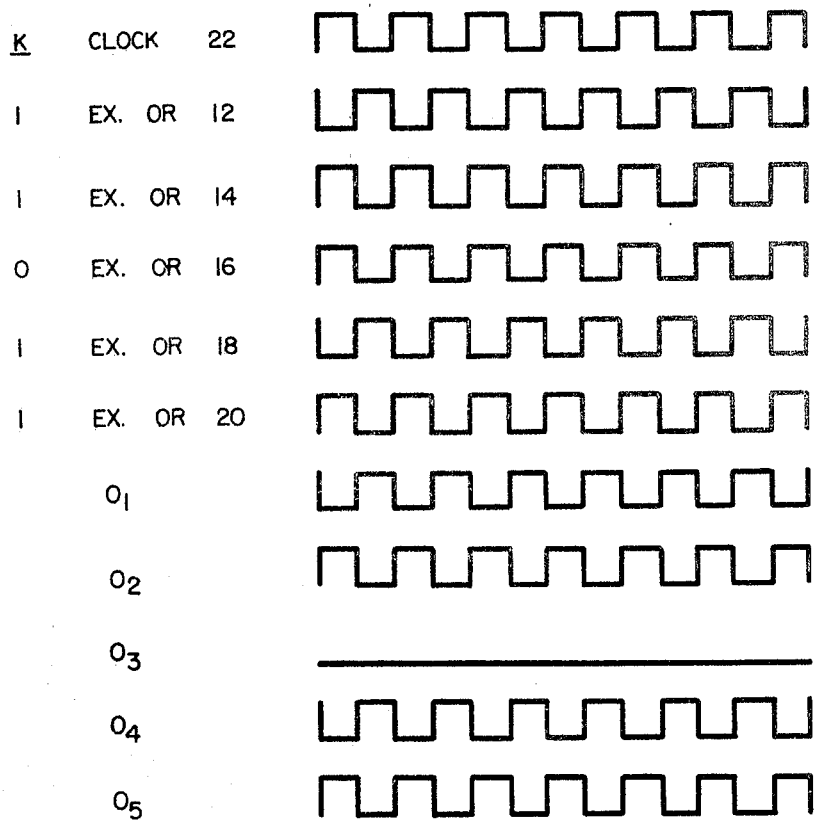
Figure 2C:
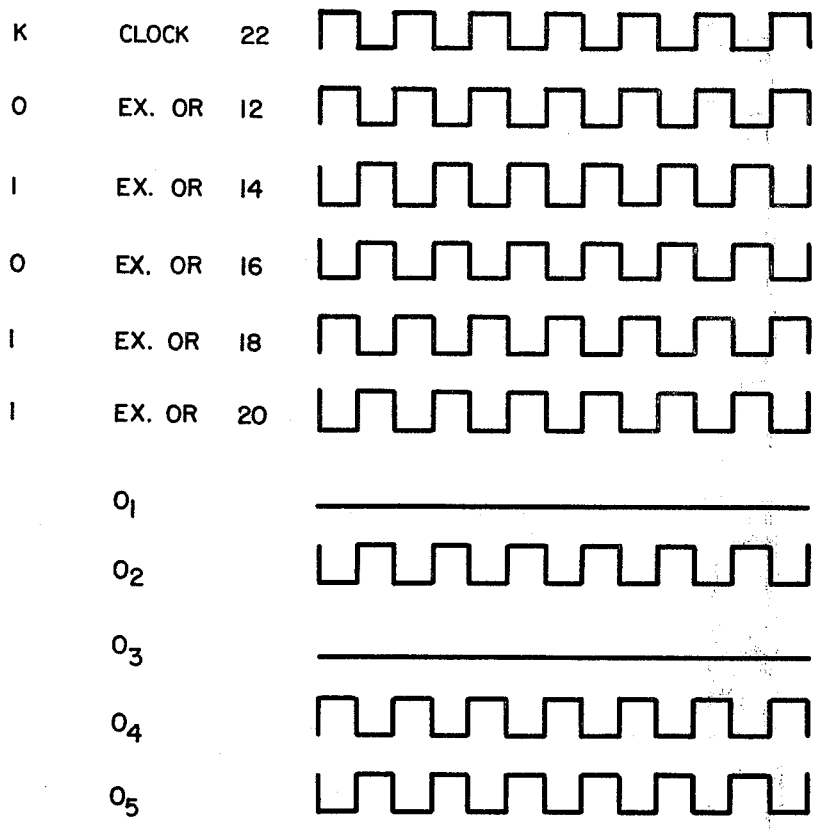

As discussed above, the output of each of the exclusive OR gates 12–20 together with the output of the associated key switch $K_1$–$K_5$ is coupled to the input of a respective one of the AND gates 22–30. Depression of one of the key switches $K_1$–$K_5$ therefore enables the associated AND gate for coupling the output of its respective exclusive OR gate as one of the keying signals $O_1$–$O_5$. The development of keying signals $O_1$–$O_5$ for three different combinations of operated key switches $K_1$–$K_5$ is illustrated in FIGS. 2A–2C. In FIG. 2A, it is assumed that only key switches $K_2$ and $K_4$ are operated so that logical 1 signals are coupled to the second inputs of exclusive OR gates 14 and 18 with logical 0 signals being coupled to the second inputs of the remaining exclusive OR gates. Considering the output of clock 22 to represent a reference phase polarity, the output of exclusive OR gate 12 will have a phase polarity identical to the reference (since its associated key switch $K_1$ is undepressed) while the phase polarity of the square wave signal produced at the output of exclusive OR gate 14 is opposite that of the reference (since its associated key switch $K_2$ is depressed). The phase polarity of the square wave signal produced at the output of exclusive OR gate 16 is the same as that of the signal produced at the output of exclusive OR gate 14 and the phase polarity of the signal produced at the output of exclusive OR gate 18 is opposite that of the signal produced at the output of gate 16. Finally, the phase polarity of the signal produced at the output of gate 20 is the same as that produced at the output of gate 18. The keying signals $O_1$–$O_5$ are shown in the last five rows of FIG. 2A. It will first be observed that keying signals $O_1$, $O_3$ and $O_5$ are all continuously low since the associated AND gates were not enabled. Keying signal $O_2$ comprises a square wave signal representing the output of exclusive OR gate 14 and keying signal $O_4$ comprises a square wave signal representing the output of exclusive OR gate 18. It will be observed that these two keying signals are 180° out of phase so that when keying signal $O_2$ is logically low keying signal $O_4$ is logically high. Similarly, when keying signal $O_2$ is logically high, keying signal $O_4$ is logically low. Since the keyers are enabled only in response to logically high keying signals, the notes corresponding to key switches $K_2$ and $K_4$ will be alternately sounded as the keying signals $O_2$ and $O_4$ alternately assume their logically high states.

With further reference to FIG. 2A, it will be observed that a similar alternating repeat effect will be realized regardless of which two key switches are operated, the first operated key switch enabling the production of a square wave keying signal having a phase polarity opposite that of the reference phase produced at the output of clock 22 and the second operated key switch enabling the production of a square wave keying signal whose phase polarity is the same as that of the reference clock.

FIG. 2B illustrates the effect of depressing four key switches, i.e., key switches $K_1$, $K_2$, $K_4$ and $K_5$. Again considering the output of clock 22 as a reference, the phase of the signal developed at the output of exclusive OR gate 12 will be 180° out of phase with the reference ($K_1=1$), the output of exclusive OR gate 14 180° out of phase with the output of gate 12 ($K_2=1$), the output of exclusive OR gate 16 in phase with the output of gate 14 ($K_3=0$), the output of exclusive OR gate 18 180° out of phase with the output of gate 16 ($K_4=1$) and the output of exclusive OR gate 20 180° out of phase with the output of gate 18 ($K_5=1$). Therefore, the outputs of exclusive OR gates 14, 16 and 20 are in phase with the clock signal while the outputs of exclusive OR gates 12 and 18 are 180° out of phase with the clock signal. Referring now to the keying signals $O_1$–$O_5$, it will initially be observed that keying signal $O_3$ is continuously low since key switch $K_3$ is unoperated ($K_3=0$). Keying signals $O_2$ and $O_5$ are identical and 180° out of phase with keying signals $O_1$ and $O_4$ which are also identical. Therefore, during each interval when keying signals $O_2$ and $O_5$ are logically high the two corresponding notes will be simultaneously sounded while the notes corresponding to keying signals $O_1$ and $O_4$ will remain off. On the other hand, during each interval when keying signals $O_1$ and $O_4$ are logically high, the two corresponding notes will be simultaneously sounded and the notes corresponding to keying signals $O_2$ and $O_5$ will be off. Thus, during each logically high half period of clock 22 the two notes corresponding to key switches $K_2$ and $K_5$ will simultaneously be sounded and during each logically low half period of clock 22 the two notes corresponding to key switches $K_1$ and $K_4$ will simultaneously be sounded.

As exemplified above, whenever an even number of key switches are simultaneously depressed, two even groups of alternatively sounding notes will result. In the illustration of FIG. 2B, four key switches were depressed so that each group of alternately sounding notes consisted of two notes, Had six key switches been depressed each group would have consisted of three notes, and so on.

FIG. 2C illustrates a final example where an odd number of key switches have been depressed, i.e. three key switches $K_2$, $K_4$ and $K_5$. Under these circumstances, the output of exclusive OR gate 12 has the same phase as clock 22 ($K_1=0$) while the output of gate 14 is 180° out of phase therewith ($K_2=1$). The output of exclusive OR gate 16 is in phase with the output of gate 14 ($K_3=0$) and the output of gate 18 is 180° out of phase with the output of gate 16 or in phase with clock 22 ($K_4=0$). Finally, since key switch $K_5$ is depressed ($K_5=0$), the output of exclusive OR gate 20 is 180° out of phase with the output of gate 18 and the clock 22. Since key switches $K_1$ and $K_3$ are unoperated, the corresponding keying signals $O_1$ and $O_3$ are continuously low. Keying signals $O_2$ and $O_5$ are identical and 180° out of phase with keying signal $O_4$. Consequently, during each logically low half period of clock 22 the two notes corresponding to key switches $K_2$ and $K_5$ will be sounded and during each logically high half period of clock 22 the single note corresponding to key switch $K_4$ will be sounded. An alternating repeat pattern is therefore produced consisting alternatively of two simultaneously sounded notes and a single sounded note.

The effect of depressing an odd number of key switches is therefore to repetitively sound the corresponding notes in alternating groups, one of the groups containing one note more than the other. Also, the effect of depressing an odd number of key switches may be realized in a number of ways. The most readily apparent manner is to simply depress, for example, three key switches as exemplified by FIG. 2C. However, the effect could also be realized by initially depressing two key switches and then some time later depressing a third switch. For example, assume the alternating repeat pattern of FIG. 2A is being played with key switches $K_2$ and $K_4$ depressed. If key switch $K_5$ is now depressed, the output of exclusive OR gate 20 will change producing a square wave signal out of phase with clock 22. Enabled AND gate 30 will produce keying signal $O_5$ which will be identical with keying signal $O_2$ such that the notes corresponding to switches $K_2$ and $K_5$ will sound simultaneously and in repetitive alteration with the note corresponding to key switch $K_4$. The effect can also be achieved by initially depressing four key switches and then releasing one of the switches. For example, if key switch $K_4$ is released in FIG. 2B, keying signal $O_4$ assumes a constant low level and the phase polarity of keying signal $O_5$ changes 180° from that shown in the FIGURE. The notes corresponding to key switches $K_1$ and $K_5$ will sound simultaneously and in repetitive alternation with the note corresponding to key switch $K_2$.

Figure 3:
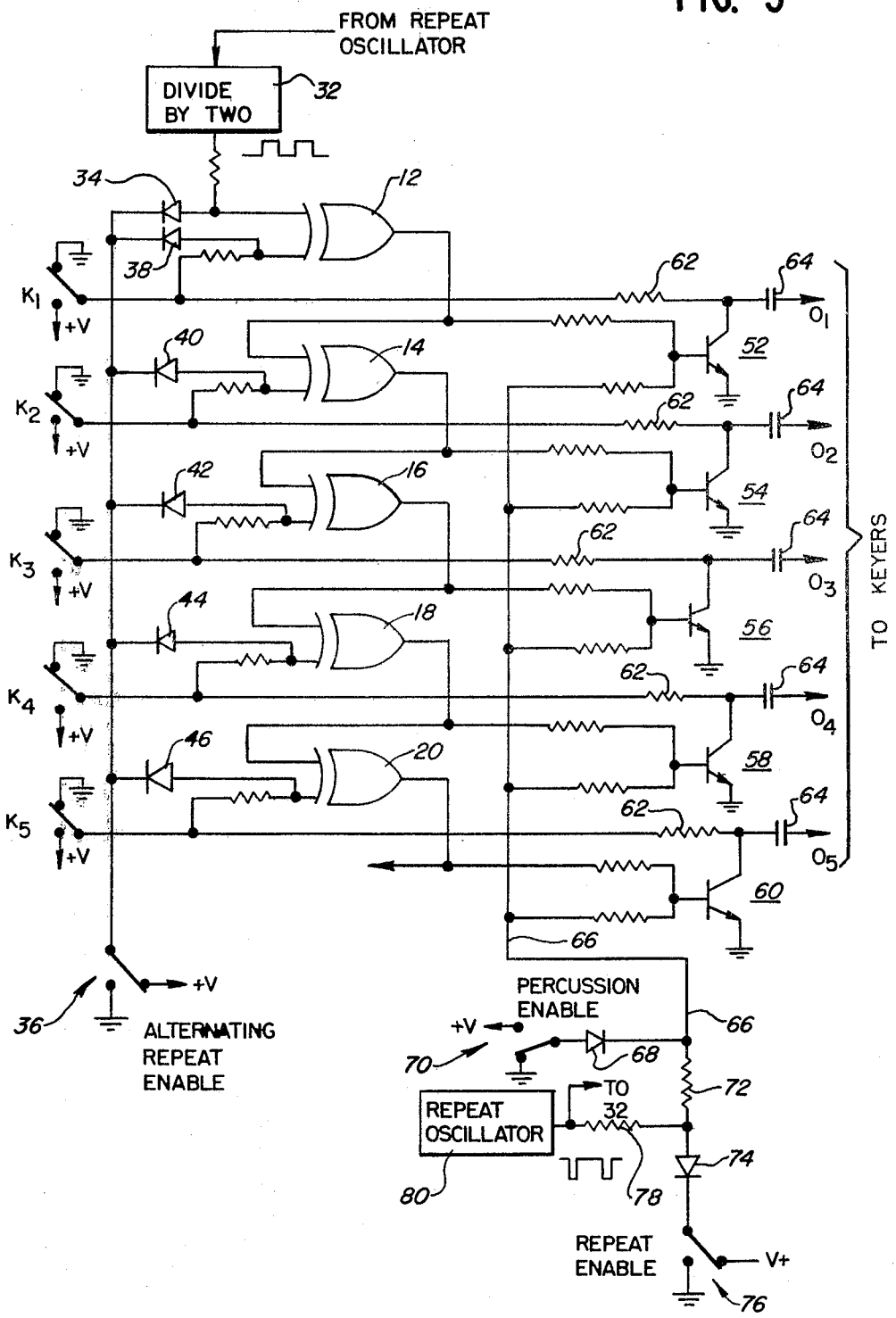
FIG. 3 is a schematic diagram showing an embodiment of the alternating repeat circuit of the invention useful for generating percussive keying signals.

FIG. 3 illustrates an embodiment of the invention suitable for producing percussive keying signals of the type required to simulate a percussive instrument such as a marimba. As distinguished from the square wave keying signals produced by the circuit of FIG. 1, a percussive keying signal normally consists of a rapidly rising attack portion followed by a gradually decreasing decay portion.

Referring in detail to FIG. 3, the illustrated percussive alternating repeat circuit includes a succession of exclusive OR gates 12–20 which are operable exactly as described with relation to FIG. 1. More particularly, a substantially 50% duty cycle square wave clock signal is resistively coupled from a divide by two circuit 32 to the first input of exclusive OR gate 12. The first input of exclusive OR gate 12 is also connected by a diode 34 to an alternating repeat enable switch 36. The second input of exclusive OR gate 12 is resistively coupled to key switch $K_1$ and by a diode 38 to the alternately repeat enable switch 36. The output of exclusive OR gate 12 is connected to the first input of exclusive OR gate 14 whose second input is coupled to key switch $K_2$ and via a diode 40 to switch 36. The remaining exclusive OR gates 16, 18 and 20 are similarly connected with the output of each gate connected to the first input of the next succeeding gate and with the second input of each gate connected to a respective key switch $K_3$, $K_4$ and $K_5$ and by a diode 42, 44 and 46 to the alternating repeat enable switch 36.

Operation of the alternating repeat enable switch 36 to its ground position forward biases each of the diodes 34, 38, 40, 42, 44 and 46. Both inputs of exclusive OR gate 12 and the second inputs of each of the exclusive OR gates 14, 16, 18 and 20 are thereby forced to a logical 0 state. As a result, the outputs of each of the exclusive OR gates 12–20 are held logically low disabling the alternating repeat feature of the circuit. Operation of the alternating repeat enable switch 36 to its other position reverse biases each of the diodes 34, 38, 40, 42, 44 and 46 enabling the exclusive OR gates 12–20 for producing a series of square wave output signals in response to the clock signal derived from the divide by two circuit 32 and the states of key switches $K_1$–$K_5$ exactly as described with reference to the circuit of FIG. 1.

Figure 4:
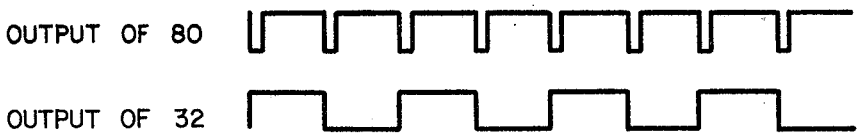
FIG. 4 is a waveform diagram illustrating the relationship between the outputs of the repeat oscillator and the divide by two circuit of FIG. 3.

The output of each of the exclusive OR gates 12–20 is resistively coupled to the base terminal of a respective switching transistor 52, 54, 56, 58 and 60, each of the transistors having its emitter terminal connected to a point of ground potential. Each of the keying signals $O_1$–$O_5$ is developed at the output of an RC circuit comprising a resistor 62 and a capacitor 64, the input to each of the RC circuits being derived from one of the key switches $K_1$–$K_5$ and the node common to each resistor-capacitor combination being connected to the collector terminal of the transistor 52–60 whose base terminal is coupled to the output of the associated exclusive OR gate 12–20. The base terminal of each of the transistors 52–60 is also resistively coupled to a control line 66 connected through a diode 68 to a percussion enable switch 70, through a resistor 72 and diode 74 to a repeat enable switch 76 and through resistor 72 and a further resistor 78 to the output of a repeat oscillator 80. Referring to FIG. 4, the output of repeat oscillator 80, which supplies the input of divide by two circuit 32, consists of a series of relatively narrow negative-going pulses whose pulse repetition rate is twice the desired frequency of the clock signal coupled to the first input of exclusive OR gate 12.

The circuit of FIG. 3 is operable in three different modes; normal percussive keying with no repeat, straight percussive repeat keying and alternating percussive repeat keying. In order to enable any of the foregoing modes it is initially necessary to operate the percussion enable switch 70 for connecting the anode of diode 68 to ground potential (logical 0). When the percussion enable switch 70 is moved to its other position a logical 1 signal is coupled to the base terminal of each of the transistors 52–60 causing the transistors to saturate and shunt any output signals to ground thereby disabling the entire circuit. With the percussion enable switch 70 in its enable position (connected to ground potential), the first of the foregoing modes, i.e. normal percussive keying with no repeat, is effected by connecting both alternating repeat enable switch 36 and repeat enable switch 76 to ground potential. The outputs of exclusive OR gates 12–20 as well as control line 66 are therefore held logically low rendering all of the transistors 52–60 non-conductive. Therefore, whenever one or more of the key switches $K_1$–$K_5$ are momentarily depressed, a logically high signal is coupled therefrom to the corresponding RC circuit, consisting of a resistor 62 and a capacitor 64, which develops a percussive output keying signal $O_1$–$O_5$ in response thereto.

Straight percussive repeat keying is effected by leaving the alternating repeat enable switch 36 in its grounded position and connecting repeat enable switch 76 to +V thereby reverse biasing diode 74 and allowing the output of repeat oscillator 80 to be developed on control line 66. Since the outputs of the exclusive OR gates 12–20 are still all logically low, the states of transistors 52–60 are determined in common solely by the output of repeat oscillator 80. In particular, each of the transistors 52–60 will be non-conductive during the relatively small time intervals coinciding with the negative-going pulses developed by repeat oscillator 80 and will otherwise be conductive. The logicallly high outputs of all depressed key switches will therefore be coupled as a repeating series of relatively narrow time coincident pulses to the associated capacitors 64. The output of each capacitor 64 associated with a depressed key switch thus comprises a repeating percussive keying signal, all of the keying signals coinciding in time such that a straight repeat effect which does not alternate between depressed keys is produced.

Alternating percussive repeat keying is effected by leaving the repeat enable switch 76 connected to +V and by enabling the exclusive OR gates 12–20 by connecting the alternating repeat enable switch 36 to +V thereby enabling the outputs of the exclusive OR gates 12–20 for controlling the states of transistors 52–60 in addition to output of repeat oscillator 80. In this regard, it will be understood that, depending on the number of key switches $K_1$–$K_5$ actually depressed, the outputs of the exclusive OR gates 12–20 will comprise a series of square wave signals formed precisely as previously explained and as shown in FIGS. 2A–2C for three exemplary combinations of depressed key switches. Considering, for example, the condition illustrated in FIG. 2A where only key switches $K_2$ and $K_4$ are depressed, it will be recalled that the output of exclusive OR gate 18 comprises a square wave signal in phase with the clock signal and that the output of exclusive OR gate 14 comprises a square wave signal 180° out of phase therewith. While the outputs of the remaining exclusive OR gates 12, 16, and 20 also comprise square wave signals they will have no effect on the circuit of FIG. 3 since their associated key switches are unoperated and therefore do not energize the RC circuits connected thereto. The depressed key switches $K_2$ and $K_4$, on the other hand, continuously couple a logically high signal to their associated RC circuits. During each half period of the clock signal when the output of exclusive OR gate 14 is logically low and the output of exclusive OR gate 18 is logically high, transistor 58 will be conductive while transistor 54 will be controlled solely in response to the repeat oscillator 80. Therefore, no keying signal will be developed at the output of the capacitor 64 connected to the collector terminal of transistor 58 while a percussive keying signal is developed at the output of the capacitor 64 connected to the collector terminal of transistor 54 in response to the negative-going pulse developed at the output of repeat oscillator 80, which negative-going pulse occurs at the beginning of the half clock period.

During each immediately subsequent half period of the clock signal the output of exclusive OR gate 14 goes logically high and the output of exclusive OR gate 18 goes logically low. As a consequence, transistor 54 will be conductive during the entire half period interval of the clock signal so that no keying signal is developed at the output of the associated capacitor 64. However, transistor 58 will now be rendered non-conductive in response to the negative-going pulse developed at the output of repeat oscillator 80 at the beginning of the half period interval whereby a percussive keying signal is developed at the output of the associated capacitor 64. It will therefore be seen that a pair of keying signals $O_2$ and $O_4$ are produced which repetitively cause the notes corresponding to key switches $K_2$ and $K_4$ to alternately sound in a percussive mode. It will also be understood that alternating repeat keying signals similar to those illustrated in FIGS. 2B and 2C will be produced when more than two keys are depressed except that the keying signals will be characterized by a percussive envelope rather than by the illustrated square wave signals.

Figure 5:
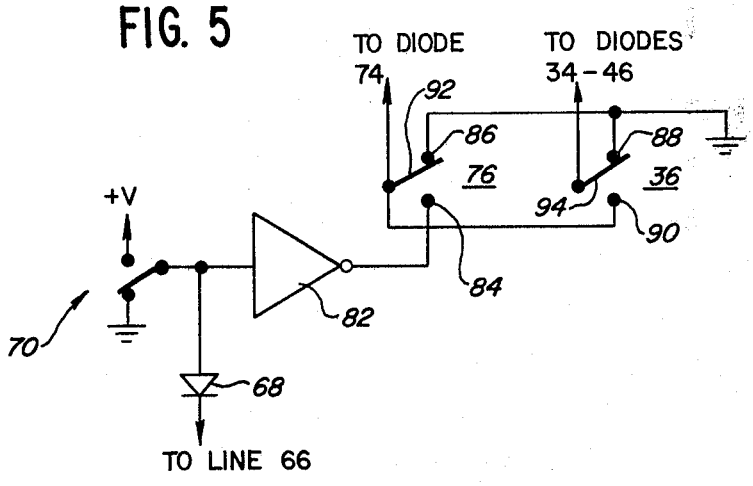
FIG. 5 is a schematic diagram showing an exemplary priority switching arrangement useful with the alternating repeat circuit of FIG. 3.

The circuit of FIG. 3 will not operate properly when the alternating repeat enable switch 36 is placed in its enabling position (connected to +V) unless the repeat enable switch 76 is also placed in its enabling position (connected to +V). It is therefore desirable to provide a method whereby the alternating repeat feature cannot be enabled unless the repeat enable switch 76 is on. An exemplary embodiment of a circuit adapted for performing this function is illustrated in FIG. 5. While the circuit of FIG. 5 incorporates a mechanical switching arrangement, as does the circuit of FIG. 3, it will be understood that similar results can be achieved using various electronic switching devices controlled either by the operator of the instrument or by internal instrument functions.

Referring to FIG. 5, the percussion enable switch 70 is connected through an inverter 82 to a first fixed contact 84 of repeat enable switch 76. A second fixed contact 86 of switch 76 is connected to a first fixed contact 88 of alternating repeat enable switch 36 and to a source of ground potential. The second fixed contact 90 of switch 36 is connected to the movable contact 92 of switch 76 which is in turn connected to diode 74. The movable contact 94 of switch 36 is connected to diodes 34–46. In operation, the logical 0 output of switch 70 is inverted by inverter 82 and developed as a logical 1 signal at contact 84 of switch 76. In order to effect the normal percussive keying mode of operation, both switches 36 and 76 are operated as shown in FIG. 5 disabling the exclusive OR gates 12–20 and the repeat oscillator 80. The straight percussive repeat mode of operation is then effected by moving the movable contact 92 of switch 76 in engagement with fixed contact 84 whereby a logical 1 signal is coupled to diode 74, diodes 34–46 still being connected to ground potential. Finally, with the movable contact 92 of switch 76 still in engagement with fixed contact 84, the alternating percussive repeat mode of operation is effected by moving the movable contact 94 of switch 36 into engagement with fixed contact 90 so that a logical 1 signal is coupled by the switch for reverse biasing the diodes 34–46. Now, assume that repeat enable switch 76 is in the position shown in FIG. 5 and that the movable contact 94 of alternating repeat enable switch 36 is again moved for engaging fixed contact 90. In this case, a logical 0 signal is still coupled to the diodes 34–46 disabling the exclusive OR gates 12–20. Therefore, the switching arrangement of FIG. 5 is effective for preventing enabling of the alternating repeat function through operation of switch 36 unless the repeat function has previously been enabled through operation of switch 76.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. In an electronic musical instrument having a plurality of playing keys and keying means associable with each of the keys, apparatus for producing alternating repeat keying signals comprising:

means for generating a clock signal;

logic means responsive to said keys and to said clock signal for producing an alternating sequence of logic signals corresponding to each of said keys, the phase of the sequence corresponding to each undepressed key being the same as the phase of the sequence corresponding to the previous key and the phase of the sequence corresponding to each depressed key being opposite that of the phase of the sequence corresponding to the previous key; and gate means for coupling a keying signal to the keying means associated with a depressed key in response to the logic signals of the corresponding sequence assuming a predetermined state.

2. In an electronic musical instrument of the type having a plurality of playing keys, apparatus for producing alternating repeat keying signals comprising:

means for generating a clock signal;

logic means responsive to said keys and to said clock signal for producing an alternating sequence of logic signals corresponding to each of said keys, the phase of the sequence corresponding to each undepressed key being the same as the phase of the sequence corresponding to the previous key and the phase of the sequence corresponding to each depressed key being opposite that of the phase of the sequence corresponding to the previous key; and a plurality of gate means each developing a keying signal in response to the depression of a respective one of said keys and the logic signals of the corresponding sequence assuming a predetermined state.

3. In an electronic musical instrument of the type having a plurality of playing keys, apparatus for producing alternating repeat keying signals comprising:

means for generating a clock signal;

a succession of exclusive OR gates each having a first input coupled to a respective one of said keys, the first of said exclusive OR gates having a second input receiving said clock signal and the remaining exclusive OR gates each having a second input coupled to the output of the preceding exclusive OR gate; and a plurality of gate means each developing a keying signal in response to the depression of a respective one of said keys and the output of the associated exclusive OR gate assuming a predetermined state.

4. Apparatus according to claim 3 wherein said means for generating a clock signal comprises means for generating a clock signal having a 50% duty cycle.

5. Apparatus according to claim 4 including first means selectively operable for disabling all of said exclusive OR gates whereby the outputs thereof are prohibited from changing state.

6. Apparatus according to claim 5 wherein each of said gate means comprises a transistor having a collector terminal coupled to a respective one of said keys, a base terminal coupled to the output of the associated exclusive OR gate and a grounded emitter terminal, said keying signals being developed at said collector terminals.

7. Apparatus according to claim 6 including means selectively operable for driving all of said transistors into conduction for prohibiting the development of said keying signals.

8. Apparatus according to claim 6 including a repeat oscillator producing a pulsating signal and means coupling said pulsating signal to the base terminal of each of said transistors for alternately driving said transistors into and out of conduction for relatively long and short time intervals respectively.

9. Apparatus according to claim 8 wherein said means for generating a clock signal comprises a divide by two circuit responsive to said pulsating signal for generating said clock signal.

10. Apparatus according to claim 8 including an RC circuit connected to the collector terminal of each of said transistors for causing said keying signals to assume a percussive nature.

11. Apparatus according to claim 10 including second means selectively operable for preventing said pulsating signal from driving said transistors into conduction.

12. Apparatus according to claim 11 including means operating said first means so long as said second means is operated.

* * * * *